United States Patent [19]

Heim

[11] 3,986,667

[45] Oct. 19, 1976

[54] STOCK-RAIL FASTENING FOR SWITCHES AND CROSSINGS OF RAILWAY TRACK INSTALLATIONS

[75] Inventor: Armin Heim, Kreuzlingen, Switzerland

[73] Assignee: Schwihag Gesellschaft fur Eisenbauh-Oberbau mbH, Tagerwilen, Switzerland

[22] Filed: Feb. 26, 1975

[21] Appl. No.: 553,103

[30] Foreign Application Priority Data

Feb. 26, 1974 Germany ..... 2409138

[52] U.S. Cl. ..... 238/349

[51] Int. Cl.[2] ..... E01B 9/30

[58] Field of Search ..... 238/349, 187, 338, 343, 238/344, 351, 361, 310

[56] References Cited

UNITED STATES PATENTS

| | | | |
|---|---|---|---|
| 2,281,750 | 5/1942 | Clarkson | 238/349 |
| 2,287,843 | 6/1942 | Tvrzicky | 238/349 |
| 3,515,347 | 6/1970 | Waters et al. | 238/349 X |
| 3,640,460 | 2/1972 | Baseler | 238/349 |
| 3,784,098 | 1/1974 | Serafin et al. | 238/349 |
| 3,799,437 | 3/1974 | Scherbaum | 238/349 |

FOREIGN PATENTS OR APPLICATIONS

| | | | |
|---|---|---|---|
| 2,107,449 | 10/1972 | Germany | 238/349 |
| 1,392,633 | 4/1975 | United Kingdom | 238/349 |

*Primary Examiner*—L. J. Paperner
*Assistant Examiner*—Randolph A. Reese
*Attorney, Agent, or Firm*—Stevens, Davis, Miller & Mosher

[57] ABSTRACT

A stock rail fastening for switches of railway track installations in which a slide chair and spring U-clip fix one flange of a stock rail to a baseplate, and a clamp fixes the other flange of the stock rail to the baseplate. The slide chair has one side overhanging the one flange and is spaced apart from the base plate to provide a recess therebetween. The spring U-clip is within the recess under bending tension and has a loop portion bearing against the one flange, and a pair of arms extending from the loop portion and having spaced apart ends supported on notches at another side of the slide chair. The entirety of the U-clip is polygonal in cross section, the arms between the loop portion and the ends have a portion which is square in cross section, and the arms each have a side face parallel to a horizontal plane when the U-clip is tension free.

7 Claims, 7 Drawing Figures

STOCK-RAIL FASTENING FOR SWITCHES AND CROSSINGS OF RAILWAY TRACK INSTALLATIONS

The invention relates to a railway switch assembly for switches and crossings of railway track installations in which the stock-rail rests on a baseplate next to a slide chair overlapping the rail base and on which the switch toe (i.e. movable switch point) slides, spanning the rail base and being provided underneath with a recess open towards the side remote from the rail. The rail is fixed towards the side remote from the slide chair by clamping plates or tension clips and on its opposite side is held by a spring U-clip designed to be braced against the rail base within the slide chair.

By DT-AS 2000 482 such as a railway switch assembly is already known. As shown in this publication the substantially U-shaped spring clip for fixing the stock rail is bent of round material.

For fixing the stock-rail the spring clip has to be pushed with its loop through the recess over an oblique plane onto the bottom of the rail where it rests under tension on a bulge formed underneath the upper boundary surface of the recess in the slide chair.

It is a proven disadvantage of this known stock-rail fastening that special tools and a considerable amount of time are required for fitting and removing the spring clips. In addition, production of the slide chair is relatively complicated on account of the bulge which has to be formed underneath the upper boundary surface of the recess in the slide chair on one side and, on the other side because of the oblique plane which has to be secured to the base plate.

To obviate the disadvantages of this known stock-rail fastening in terms of installation and dismantling a stock-rail fastening, there is also well known via a main application for a patent, no. P 21 53 534.2 (DT-OS 2153 534) a spring clip which can be both installed and dismantled tension-free, and in which the retaining tension of the spring clips required to fix the stock-rails can readily be applied and taken up again, for example by means of a one-armed lever. According to P 21 53 534.2 this problem is essentially solved by virtue of the fact that notches situated above the plane of the baseplate are associated with the slide chair at its rear end, into which each end of the U-shaped spring clip situated to the front on the rail base is designed to be lifted under compression, and is supported against the upper boundary surface of the recess in the slide chair.

This construction of a stock-rail fastening has not only been favorable because of the easy fitting and dismantling of the spring clip but also because of its performance during extensive durability tests.

The formation of the spring clip of the stock-rail fastening according to DT-OS 21 53 534 nearly conforms to the spring clip according to DT-AS 2000 482, i.e. both of them are substantially of a U-shaped original form and are produced of round material. Furthermore the spring clips are deformed opposite the horizontal plane, so that they can only be pushed into the recess of the slide chair in one position.

The object of the invention is to improve the spring clip for stock-rail fastenings so that in opposition to other spring clips a higher section modulus and therewith a higher initial tension can be reached especially in connection with the construction of the slide chair according to P 21 53 534.2, and to improve the spring clip in consideration of losses of the section caused by corrosion after a longer period of installation.

One further object of the invention is an improved spring clip having an essential prolonged durability and the possibility of universal installation of the spring slip.

Proceeding from this proposition the substantial invention is that the spring clip is formed like a polygon, especially square in its section, and has two side faces parallel to one horizontal plane.

With these featues an essentially higher section modulus of the spring clips can be obtained without changing the installation. Even if there arises losses of the section caused by corrosion the spring clip will have a durability which is twice as much as that of the other known spring clips.

According to another characteristic of the invention the spring clip is formed straight in its longitudinal direction to the horizontal plane, so that it has no special position for the installation. Much more, it is possible to turn the spring clip by 180° of its position of installation after a certain period of installation, if necessary.

One further characteristic feature of the invention stock-rail fastening can be seen in the fact that the loops of the spring clips are chamfered symmetrically to the horizontal plane of the spring clip. By this chamfer a lower height of the assembly results in the range of the rail base and this allows the use of the spring clips still at a height of the slide chair of 30 mm only.

The spring clip also may be more simply fitted as a result of a symmetrical chamfer to the horizontal plane on both ends of the arms of the spring clip, because the distance resulting therefrom between the ends of the arms and the surface of the groundplate make it possible to put the mounting lever underneath. Furthermore the oblique plane gusset is no longer necessary as the loop can be lifted by pressing down both of the chamfered arms and by pushing the spring clips on the rail base easily and without any tension.

Another proven and efficient feature of the invention is that the spring clip is reflected symmetrically in its vertical plan and its arms are bowed towards each other from their open end to a small gap. Due to this a moving out of the spring clip from its notches can be avoided safely and when high frequencies occur.

Nevertheless to allow taking out the spring clips from the notches of the slide chair, if necessary, according to the invention it is foreseen that the arms in the range of the gap are symmetrical to the main plane, having round areas with one supporting surface of at least 1 mm height situated between each of them.

After installation the notches prevent no desired movement of the arms of the spring clip on the notches. But a slanted lifting of the arms with use of the tool is possible because the slanted areas which are facing diagonally allow a side movement if one end of the arm of the spring clip is lifted.

Finally one characteristic feature of the invention is that the arms of the spring clips are completely straight on their whole length between the loop and the gap and, therefore, no folds or pinches can arise in the range of the maximum load of the spring clip, which will crack open at tensile stress during durability tests and lead to a break down of the spring clip.

An embodiment of the invention is shown by way of example in the accompanying drawings, wherein.

Figure 1:
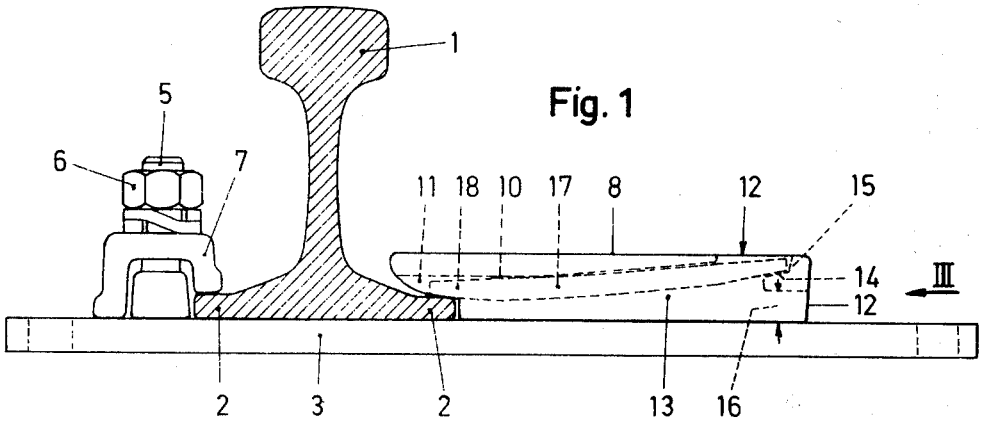
FIG. 1 is a view towards the longitudinal axis of the rail, partly in section.
Figure 2:
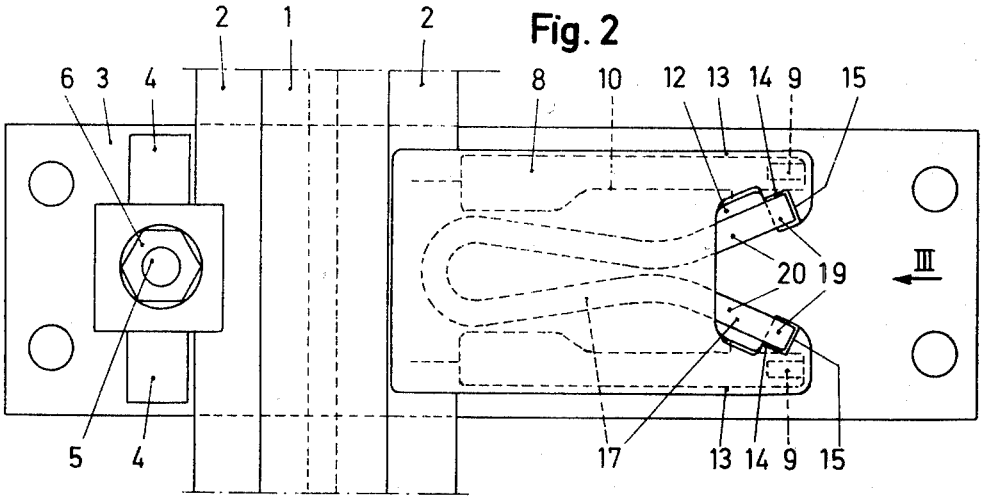
FIG. 2 is a plan view of the stock-rail fastening shown in FIG. 1.
Figure 3:
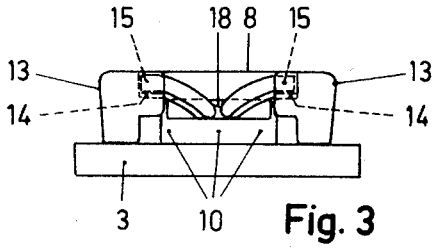
FIG. 3 shows the stock-rail fastening illustrated in FIGS. 1 and 2 as seen in direction of arrow III.

In the stock-rail fastening shown in FIGS. 1 to 3 of the drawing the stock rail 1 rests with its base 2 on a baseplate 3 which can be fixed to a sleeper by means of screws.

The base of the rail 2 rests against a rib 4 which is situated on the baseplate 3. By means of turnbuckle or bolt 5 anchored in the rib and a nut 6, a clamping clip 7 for example can be pressed on the part of the rail base neighboring the rib 4.

On the opposite side of the stock rail 1 there is a slide chair 8 on the baseplate 3 for a switch blade which is overlapping with space the neighboring part of the rail base 2.

The slide chair 8 on the one side and the baseplate 3 on the other side border the recess 10, which extends across the total length of the slide chair. At the opposite end of the slide chair 8 there is a recess 12 which is bounded by lateral webs 13 each of which have a notch 14 with supporting stops 15 at their inner side, The notches 14 are situated above the baseplate by such a distance that an interval 16 is formed between them and the baseplate.

A spring clip 17 in its tension-free form can be pushed through recess 12 into the recess 10 of the slide chair 8 so that its loop 18 near the end 11 of the recess 10 can clip up onto the inner part of the rail base 2. In this position of the spring clip 17 the ends of the arms 20 are situated below the notches in the range 16, from where they can be pressed inwards away from the notches 14 and afterwards lifted up onto the notches 14 by help of a lever tool which is supported by the lateral webs 13. Thus, the loop 18 is braced on the upper side of the rail base 2 while on the other hand the arms of the spring clip lie against the upper surface of the recess of the slide chair. By means of pushing the ends 19 of the arms 20 onto the notches 14 the arms 20 are set under bending tension and therewith press the loop 18 under high power onto the inner part of the rail base 2.

The supporting stops 15 with lateral webs 13 work together with the back surfaces of the end of the arms 19 to avoid the spring clip 17 from being removed in its longitudinal direction and from sliding down from the rail base 2 as a result of vibration.

Figure 6:
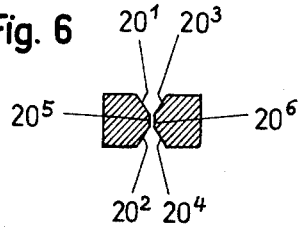
FIG. 6 is a sectional view along the line VI—VI in FIG. 4.
Figure 7:
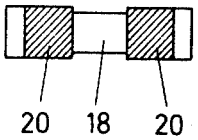
FIG. 7 is a sectional view along the line VII—VII in FIG. 4.

Furthermore the side faces of the supporting stops and the sides of the arms 19 work together so that the spring clip does not need a stop in front of the loop at the rail base, since for an unwanted sliding up from the base of the rail it would be necessary that the two arms come closer by more than 1 mm in the range shown in FIG. 6, which is not possible because of inside faces of the spring clip which are only 1 mm apart from each other.

Figure 4:
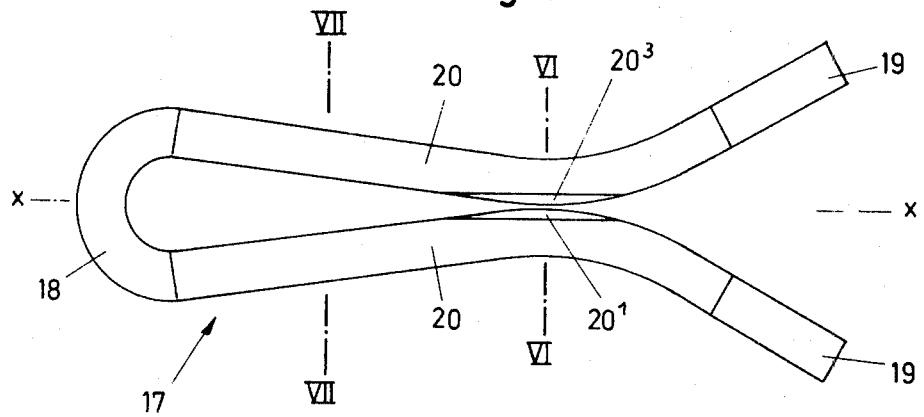
FIG. 4 is an enlarged plan view of the invented spring clip for the stock-rail fastening according to FIGS. 1 to 3.

FIGS. 4 to 7 show the special design of the spring clip 17. The plan view according to FIG. 4 shows that the arms 20 are inclined towards each other from the loop 18 and symmetrical to the middle axis X—X until their facing inner sides nearly touch each other in the range of the plane of section VI—VI. In the range jutting out over the plane of section VI—VI the arms 20 again are symmetrically apart up to their ends 19 with respect to the axis X—X.

The spring clip is constructed so that the arms 20 in the range between the loop 18 and the plane section VI—VI are nearly formed in a straight line, and from there with a relatively large radius of bending going over in the ranges leading to the ends 19 which are again designed in a straight line.

Figure 5:
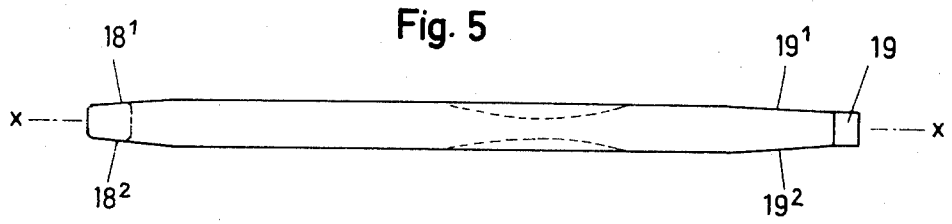
FIG. 5 is the side view of the relaxed spring clip according to FIG. 4.

FIG. 5 makes clear that the spring clip 17 seen from the side is formed symmetrically along the longitudinal axis, i.e. it is formed completely in a straight line and has only chamfers $18^1$ and $18^2$ and also chamfers $19^1$ and $19^2$ at both sides in the range of the ends of the arms 19.

The section of the spring clip 17 is in form of a polygon at all parts. The arms 20 in their straight ranges lying between the loop 18 and the plane section VI—VI show a square section as it appears clearly in FIG. 7. In the range of the loop 18 the square section gradually changes in that way, that it passes over to a rectangle and then to a trapezoid, whereby the form of a trapezoid is strongly marked in the range of the vertical plane along the longitudinal axis X—X. This change of the section in the range of the loop 18 results as a consequence of the chamfers $18^1$ and $18^2$ placed here on both sides.

At the ends of the arms 19 in the range of the chamfers $19^1$ and $19^2$ the square section also changes gradually into a form of a rectangle. At the place where the radii, of bending are at both arms 20 of the spring clip 17, there are actually two radii $20^1$, $20^2$ and $20^3$, $20^4$, respectively, put in position at the inner side of the arms 20 symmetrical to the horizontal plane along the longitudinal axis X—X which can clearly be seen from FIG. 6. Between both of the radii $20^1$, $20^2$ and $20^3$, $20^4$, respectively, provided at the same arm 20, supporting sufaces $20^5$, $20^6$, respectively, are provided and border a narrow gap between the inner sides of the both arms and which are parallel to the vertical plane along the axis X—X. Thus, the arms 20 have partly round and partly rectangular sections in the range of the plane of section VI—VI.

By means of the construction described above the spring clip can be pushed into the recess 10 of the slide chair 8 in two positions, and turned with respect to each other by 180° without more ado whereby its loop 18 rests upon the inner side of the rail base 2 with its chamfers $18^1$, $18^2$, respectively, lying underneath.

The chamfers $19^1$, $19^2$, respectively at the end of the arms 19 lying underneath at times offer the possibility of putting the lever tool below for spanning the spring clip 17. Furthermore the chamfers $19^2$, $19^1$, respectively, lying underneath at times make it possible to lift the loop 18 by pressing down the ends of the arms so that the spring clip can be pushed easily on the rail base tension-free and without a guide wedge.

If one of the arms 20 is lifted for the purpose of putting it in the notches 14 at the slide chair 8 with the help of the lever tool the supporting surfaces $20^5$ and $20^6$ are changed with respect to each other in their level and both of the arms 20 can make movements upwards as well as aside and towards each other in the range of radius $20^1$ and $20^4$ or $20^2$ and $20^3$ coming in touch with one another so that the ends of the arms 19 can be lifted onto the notches 14 of the slide chair 8 with little input.

When both ends of the arms 19 of the spring clip $17_5$ rest upon the notches 14, both of the supporting surfaces $20^5$ and $20^6$ are again on the same level, side by side and make it surely impossible that the ends of the arms 19 can slide down from the notches 14 of the slide chair 8 as a result of vibration.

It still should be mentioned that the polygon section of the arms 20 has been placed so, that two parallel side faces of the section are running to the horizontal plane along the longitudinal middle axis, i.e. that the tension-free spring clip 17 has a relative broad bearing surface at both sides of the horizontal plane along the longitudinal middle axis X—X.

Because of the polygon, especially the square section of the spring clip, it becomes quite a high section modulus, which is essentially higher than that of a round section, if one considers losses of the section caused by corrosion. By means of this, the durability of the spring clip 17 is increased three-fold at least.

A further advantage of the polygon section is that the spring clip 17 has a bearing surface at all critical points and so has a much lower surface pressure which effects less abrasion.

The elimination of the abrasion effects means that also after a long period of installation still the same geometry of spanning, i.e. load capacity, still will be produced with the spring clip 17.

I claim:

1. A stock rail fastening for switches of railway track installations, in which a stock rail having a first flange and a second flange rests on a baseplate, and a switch toe spans the bottom of the rail, and clamping means fixes the first flange to the baseplate, said rail fastening comprising:

a. a slide chair, for the switch toe, adjacent the second flange and having one side overhanging the second flange, said slide chair being spaced apart from the baseplate to form a recess therebetween and having an opening at another side opposite said one side and remote from the rail, said another side having notches; and b. a spring U-clip within the recess having a loop portion bearing against the second flange and a pair of arms extending from said loop portion and having spaced apart ends supported in said notches, said arms being under bending tension; the entirety of said U-clip being polygonal in cross section, said arms between said loop portion and said ends having a portion which is square in cross section, and said arms each having a side face parallel to a horizontal plane when said U-clip is tension free.

2. A stock rail fastening according to claim 1 wherein when the spring U-clip is viewed from its side in a tension free state, said arms are straight and symmetrical about a horizontal plane lying along the longitudinal axis of said U-clip.

3. A stock rail fastening according to claim 1 wherein said loop portion is chamfered symmetrically about the horizontal plane of said U-clip.

4. A stock rail fastening according to claim 1 wherein said ends are chamfered symmetrically about the horizontal plane of said U-clip.

5. A stock rail fastening according to claim 1 wherein said loop portion and said arms are symmetrical about a vertical plane lying along the longitudinal axis of said U-clip, and said arms have a small air gap between said loop portion and said spaced apart ends, said gap being smaller than the distance between said spaced-apart ends.

6. A stock rail fastening according to claim 1 in which said arms of said U-clip have a small air gap between said loop portion and said ends, said gap being formed by a rounded segment of said arms, the portions of said rounded segment which face each other being chamfered to present two surfaces on each arm which lie symmetrically to a horizontal plane and a third surface on each arm which connects said two surfaces and extends across the horizontal plane.

7. A stock rail fastening according to claim 1 in which all the sides of the arms of said U-clip between said air gap and said loop are straight.

* * * * *